United States Patent [19]

Hartman

[11] 4,345,397

[45] Aug. 24, 1982

[54] ALTERNATE FIRING METHOD

[76] Inventor: Mondo L. Hartman, R.R. 2 Box 281, Kalkaska, Mich. 49646

[21] Appl. No.: 136,684

[22] Filed: Apr. 2, 1980

[51] Int. Cl.[3] ..... F41C 19/00

[52] U.S. Cl. ..... 42/42 B; 42/69 R

[58] Field of Search ..... 42/42 B, 42 R, 40, 69 R

[56] References Cited

U.S. PATENT DOCUMENTS

| | | | |
|---|---|---|---|
| 51,440 | 12/1865 | Elliot | 42/42 B |
| D. 219,652 | 1/1971 | Ruger et al. | 42/40 |
| 982,152 | 1/1911 | Marble | 42/42 B |
| 3,786,588 | 1/1974 | Soana | 42/42 R |
| 4,026,056 | 5/1977 | Roman | 42/42 R |

*Primary Examiner*—Charles T. Jordan

[57] ABSTRACT

A mechanism to fire a double barrel shotgun, and so arranged to fire each barrel alternately in perfect sequence, starting with either barrel and by a simple adjustment to fire either barrel continuously with a single outside two piece hammer and a single trigger, the said hammer hinged to provide a limited lateral movement to the front face of the hammer with sufficient lateral range to be easily directed to the right barrel or the left barrel as determined by the selector cam.

5 Claims, 13 Drawing Figures

ALTERNATE FIRING METHOD

This invention relates to the firing mechanism of a double barrel shotgun, arranged to fire the barrels alternately or each barrel continuously. More specifically, this firing arrangement will fire either barrel with a predetermined sequence with but one hammer, eliminating the need for a hammer for each barrel.

BACKGROUND OF THE INVENTION

It is known that hammerless shotguns of all types, whether single or double barrel, that the hammer is brought to full cock on the opening of the action and that the gun is in full battery as soon as the action is closed on a live shell.

The gun is then immediately dependent on a safety device, whether automatic or manual, for preventing accidental discharge of the arm.

It is known that hammerless guns have misfired on the careless or harsh closing of the action on a live shell, a light tripper pull, or a defective safety device is sometimes responsible for these accidental misfires.

The object of this invention is to provide a double barreled shotgun with a firing mechanism that is separate from the loading action and can be carried and handled in perfect safety from accidental discharge.

SUMMARY OF THIS INVENTION

This invention presents an arrangement for preselecting the firing sequence of the barrels comprising of a two piece hammer with the forward face of the hammer pivoted, allowing limited lateral side to side movement of the hammer face, a cam pivoted with a lateral movement on a plane with the hammer face, a means of locating said cam selectively in first, second, and third positions. Said positions being spaced apart on the axis of a control pin to predetermine which barrel will be fired first, either in sequence of continuous firing of either barrel.

BRIEF DESCRIPTION OF THE DRAWING FIGURES

DESCRIPTION OF THE INVENTION

Figure 1:
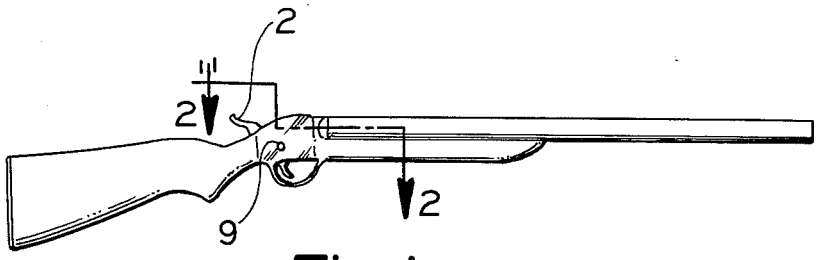
FIG. 1 is a profile of a double barrel shotgun with the general area concerned by this invention indicated by section 2—2.

With reference to the drawings, FIG. 1 represents generally a shotgun with two barrels superimposed or arranged side by side. More specifically, the drawing figures benefit and show the side by side arrangement of the barrels.

Figure 2:
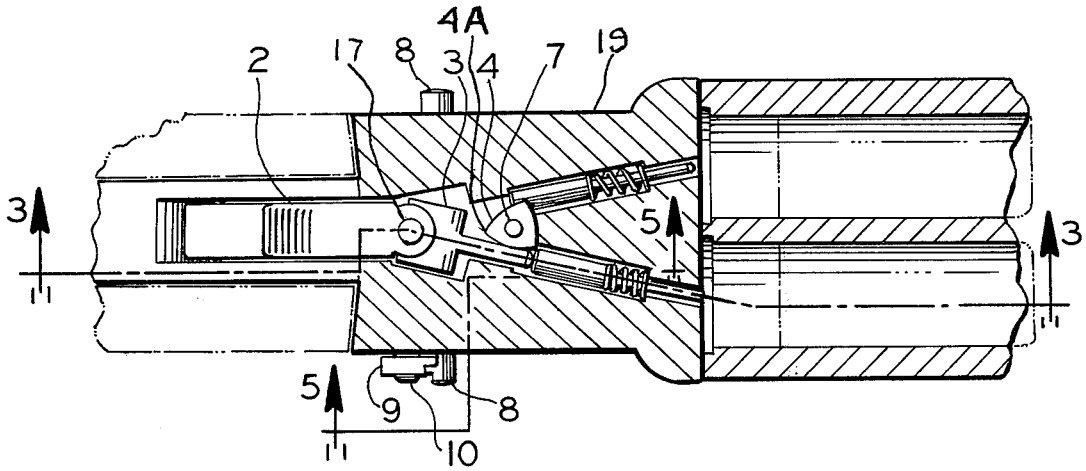
FIG. 2 is a plan view showing the relative position of the selector cam with the hammer when the hammer is in safe position.
Figure 3:
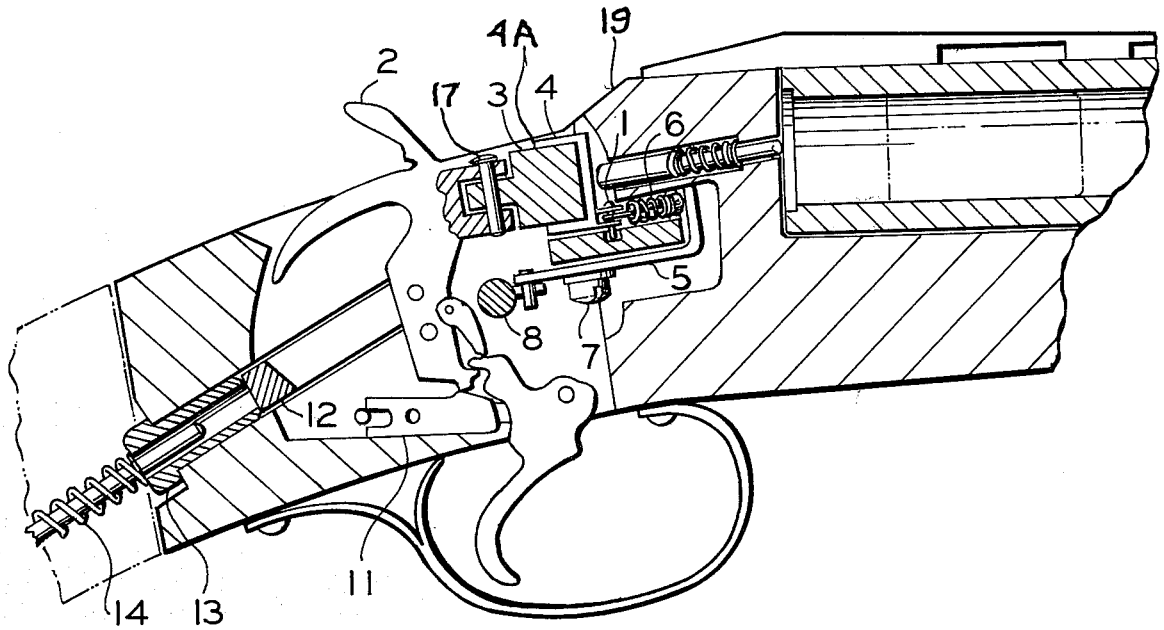
FIG. 3 is a side elevation view of the mechanism to fire a double barrel gun with one hammer, including an arrangement for preselection of the firing sequence: taken on line 3—3 of FIG. 2.
Figure 4:
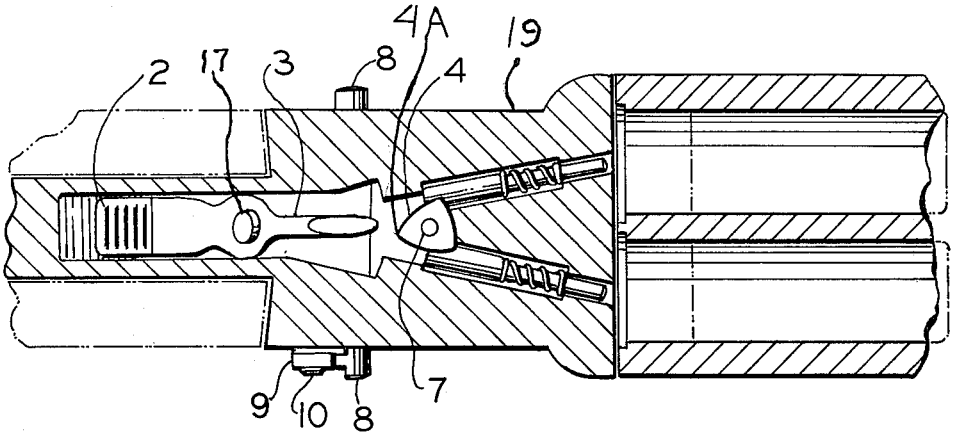
FIG. 4 is a plan view sectional to show the relation of the selector cam and a hammer when the hammer is at full cock.
Figure 5:
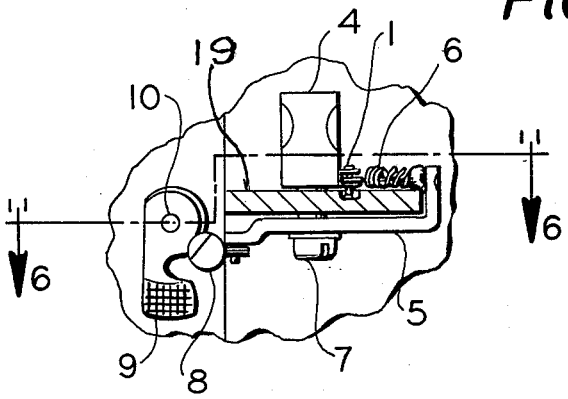
FIG. 5 is an elevation view taken on line 5—5 of FIG. 2 showing the selector the cam with a pocket in the base and a pin in the cam extending into the pocket, limiting the rotating side to side movement of the cam.

In FIGS. 2 and 3, hammer 2 is shown in the safe rest position in which it is disposed after a shot has been fired. The hammer 2 is effectively held in this safe position by sliding block 11, FIG. 3, in coincidence with frame 19 contacting radially with hammer 2 effectively prevents any forward pivotal movement of hammer 2. It will be seen that the hammer face 3 pivotal by pivot pin 17 to the hammer 2, FIG. 4, that the hammer face 3 has been wiped by the close confinement with the frame 19 into a central position in line with hammer 2 and central with selector cam 4 maintaining this central position until the hammer 2 is released and is driven forward by spring 14, FIG. 3, until hammer face 3 is in coincidence with the face of selector cam 4 and is then directed by cam 4 to the preselected barrel.

The proper direction of hammer face 3 to the preselected barrel is accomplished by point 4A of cam 4 being pivoted to one of its two off center positions. The point 4A, of cam 4 being off center with the gun and frame, allows the hammer face 3 as it approaches on center with the frame to bypass point 4A, and striking the face of cam 4, there by being directed to the side of the broadest exposed face of cam 4, cam 4 being pivoted on the same plane with hammer face 3, is rotated to firing position of the remaining barrel by the forward movement of hammer.

Figure 6:
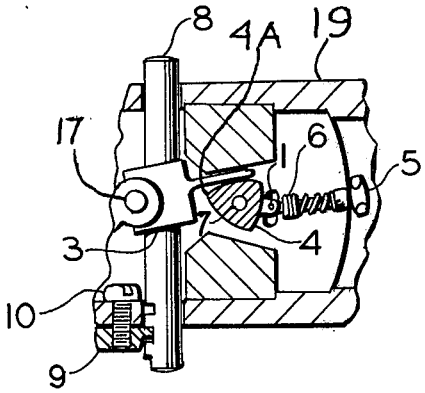
FIG. 6 is a plan view taken on line 6—6 of FIG. 5 showing the pivoted forward face of the hammer in safe position relative to the selector cam and the first, second, and third positions located axial on the control pin and means to lock the pin in any of the three preselected positions.
Figure 7:
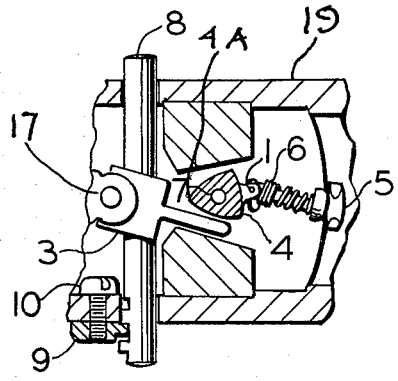
FIG. 7 is the same as FIG. 6 excepting that the pivoted forward face of the hammer is shown on the opposite or right side of the selector cam.
Figure 8:
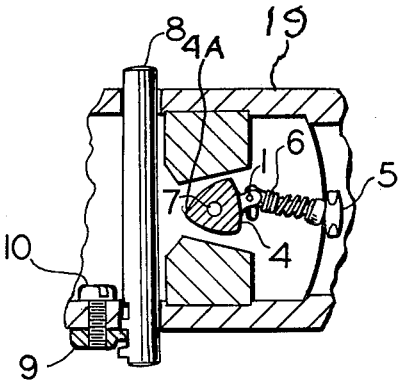
FIG. 8 is the same sectional view as shown in FIG. 6 and FIG. 7 with the pivoted forward face of the hammer removed.

Spring 6 is pivotally attached by the ends between selector cam 4, FIG. 6, and positioning lever 5 forming an over center spring action between cam 4 and lever 5. When lever 5 is in the center position, resulting in the lateral side to side flip of selector cam 4 producing sequential firing of the barrels, FIGS. 6-7-8.

Figure 9:
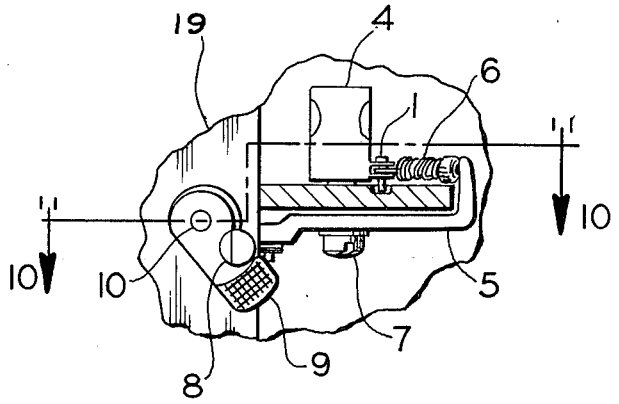
FIG. 9 is a side view of the selector cam, adjusting pin, and means to lock the pin in any one of the first, second, or third preselected positions.
Figure 10:
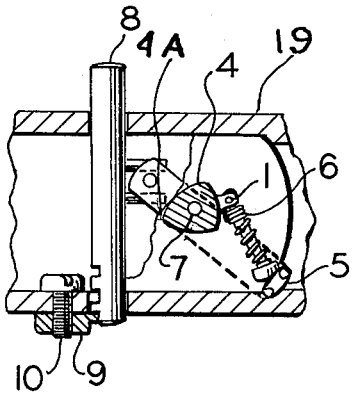
FIG. 10 is a cross sectional plan view taken on line 10—10 of FIG. 9 showing the position of the selector cam and spring with the control pin moving parallel to its axis to the first position and securely locked in place.
Figure 11:
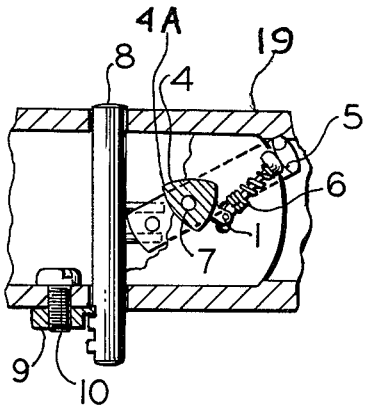
FIG. 11 is the same view as FIG. 10 except that the control pin is moved parallel to its axis to the third position showing the relative position of the selector cam and spring.

Control pin 8 (shown in sectional views FIGS. 10 and 11 taken from section line 10—10 FIG. 9) locked in any one of the first, second, or third positions, these positions being spaced apart parallel along the axis of the control pin 8 and locked in position by lever 9, FIG. 9, controls the position of the positioning lever 5. Positioning lever 5 is pivoted with cam 4 threaded pin 7, FIG. 9, providing a lateral movement of lever 5 entirely independent of cam 4 as shown in FIGS. 10–11. The actuated end of positioning lever 5 being loosely but firmly connected to control rod 8 is shown, FIG. 11, in the third position with the spring 6 end bearing on lever 5 is the extreme left off center position.

Figure 12:
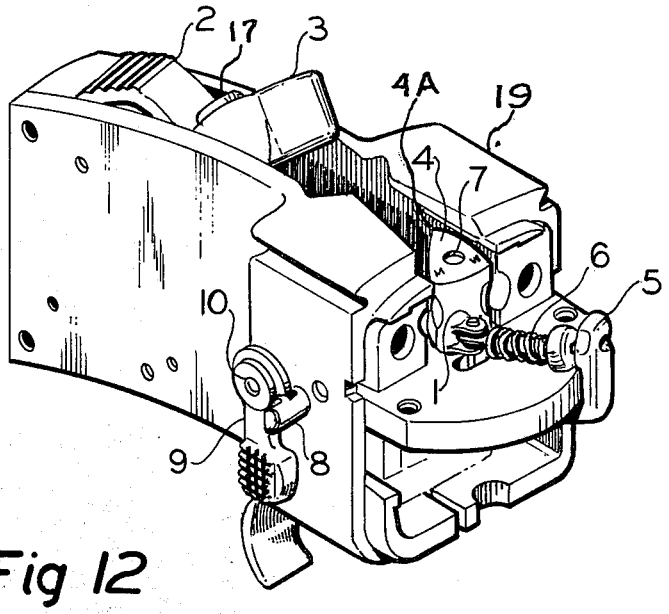
FIG. 12 is a perspective drawing of the assembled receiver as viewed from the front or barrel end of the gun, showing the hammer in full cock, and the cam selector, spring, and control pin locked in the third position resulting in continuous firing of the right barrel.

Pressure from spring 6 on cam 4 and pivot pin 1 maintains cam 4 in its extreme limted position, provided by the pin 1 in a pocket in the frame. The off center feature of spring 6 being cancelled by the off center position of lever 5, returns cam 4A to the original position, resulting in continuous firing of the right barrel, FIGS. 11–12, reversing 5 with pin 8 moved parallel to its axis to first position. Pin 1 extending into the pocket in the frame providing limited parallel movement.

A reverse of this firing arrangement with pin 8 moved parallel to its axis to the first position locating lever 5 and spring 6 to the opposite off center position allowing pressure of spring 6 to pivot cam 4 to the opposite stop provided by pivot 1 extending into the pocket in the frame moving pivot 4A to opposite left of center position, allowing continuous firing of the left barrel only as illustrated in FIG. 10.

FIG. 10 locking lever is very important to the reliable operation of this firing arrangement, requiring a reliable locking arrangement to secure pin 8 in any of the three selected positions. It cannot become unscrewed and become lost, pin 8 being connected to lever 5, said pin cannot be moved far enough axially to permit lever 9 from becoming unscrewed from screw 10. To permit the unscrewing of lever 9 it would be required to disassemble lever 5, cam 4, and threaded pivot pin 7 in order to move pin 8 axially far enough to unscrew lever 9 from screw 10, then remove screw that had been tightened securely in the frame, completing the diassembly.

Figure 13:
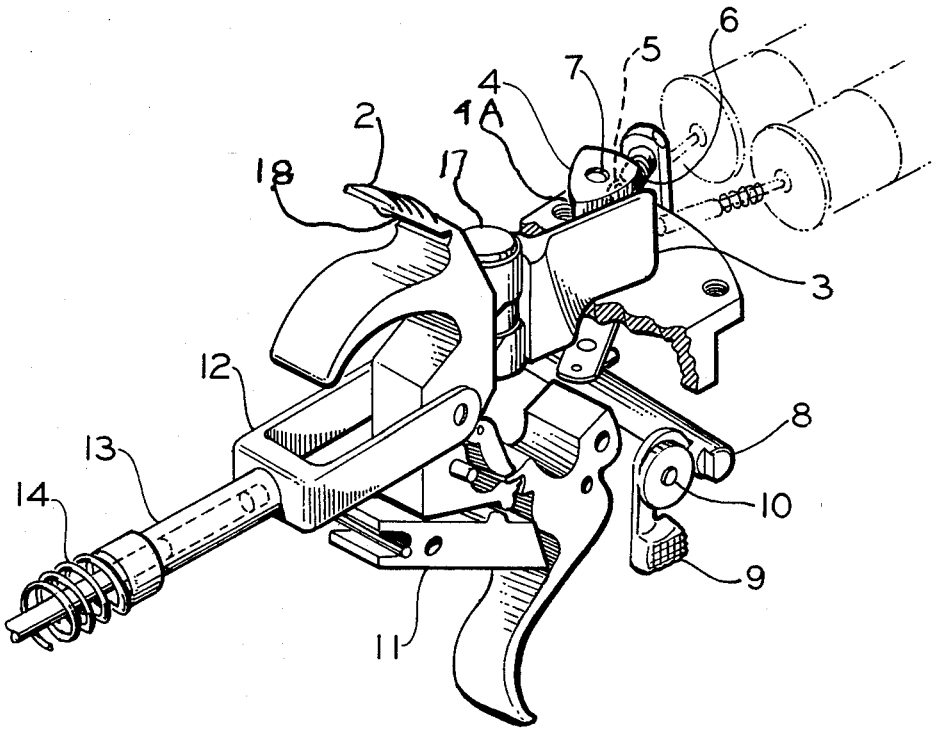
FIG. 13 is a perspective view of the assembly of the mechanism of this invention to fire a double barrel shotgun using but one outside hammer and a single trigger.

FIG. 13 is a grouping of the components of this invention shown in isometric view, showing scarf 18 at the base of hammer spur 2. The purpose of said scarf is to reduce the breaking pressure required to break off the spur 2 to a tolerable level.

With this mechanism preventing the forward pivotal movement supplied by block 11 wedged between frame 19 and the base end of hammer 2, thereby preventing the firing of the gun and any damage to the rest of the components. Spring 14 is effectively stopped in its forward movement by pressure on the hammer 2, by resting against the frame, FIG. 19, thereby relieving all pressure. The stopping of the spring 14 by frame 19 and the wedging of the block under the hammer base is coincidental thereby relieving the firing mechanism of any pressure from spring 14, adding greatly to the safety of the gun.

It is noted from the foregoing description that the mechanical arrangement of firing a double barrel gun is simple, dependable, and safely accomplished with but one hammer and a single trigger.

I claim:

1. A double barrel firearm having a frame, a stock, and a firing mechanism; said firing mechanism comprising a hammer having a pivoted front face, a release catch, a single trigger, and selector means for selecting the firing sequence of the barrels; said selector means comprising a selector cam pivotably mounted in said frame by a pivot pin for deflecting said hammer front face to a selected barrel, and means locating said cam selectively in first, second, and third positions; said locating means comprising a positioning lever, a compression spring with one end attached to said lever and the other end attached to said cam, and a control pin for moving said lever; said control pin being positionable in first, second, and third positions to move said cam to its first, second, and third positions; said first and third positions allowing continuous firing of either of the barrels, and the second position allowing automatic sequential firing of the barrels; and a locking means for holding said control pin in each of its positions.

2. A firearm according to claim 1, wherein said hammer comprises two parts, a main body part pivotaly mounted in said frame and a smaller front part pivotably mounted to said body part by a pivot pin; said front part being free to pivot toward the selected barrel; and said selector cam pivot pin and said hammer front part pivot pin are parallel.

3. A firearm according to claim 1, wherein said locking means for said control pin comprises a locking lever for locking said control pin securely in said frame; said locking lever being mounted on the outside of said frame by a screw firmly tightened against the inside of said frame and having sufficient length to extend through the frame and into a threaded bore in said locking lever; and the threads on said screw and in said locking lever bore being synchronized such that said locking lever will tighten securely in the right position.

4. A firearm according to claim 1, wherein said hammer has a hammer linkage for engagement with the hammer spring bushing; said bushing having a larger diameter section and a smaller diameter section; said smaller diameter section having a length such that, when said hammer is disposed in a safe position, said smaller diameter section of said bushing extends through a hole in said frame and contacts said hammer linkage as said larger diameter section of said bushing contacts a rear surface of said frame; and said stock has a recess therein for receiving a hammer spring compressed between the bottom of said stock recess and said hammer spring bushing.

5. A firearm according to claim 1, wherein said hammer has a hammer spur and a safety groove at the base of said spur such that the hammer spur is sufficiently strong for normal use, but weakened to the extent that said spur will break off under rough usage without discharging the firearm.

* * * * *